US007694480B2

(12) United States Patent
Niese et al.

(10) Patent No.: US 7,694,480 B2
(45) Date of Patent: Apr. 13, 2010

(54) PANEL-TYPE SUBFLOOR FOR ATHLETIC FLOOR

(76) Inventors: Michael W. Niese, 7290 State Rd., Cincinnati, OH (US) 45230; John Richard Puening, 3320 Riverhills Dr., Cincinnati, OH (US) 45244

( * ) Notice: Subject to any disclaimer, the term of this patent is extended or adjusted under 35 U.S.C. 154(b) by 72 days.

(21) Appl. No.: 11/476,193

(22) Filed: Jun. 27, 2006

(65) Prior Publication Data

US 2007/0039269 A1 Feb. 22, 2007

Related U.S. Application Data

(60) Provisional application No. 60/694,282, filed on Jun. 27, 2005.

(51) Int. Cl.
*E04F 15/22* (2006.01)
*A63C 19/00* (2006.01)

(52) U.S. Cl. ..... 52/403.1; 52/480; 52/747.1; 472/92

(58) Field of Classification Search ..... 52/403.1, 52/480, 309.8, 309.9, 410, 796.1, 506.05, 52/747.1, 747.11; 472/92
See application file for complete search history.

(56) References Cited

U.S. PATENT DOCUMENTS 1,787,067 A * 12/1930 Eisler ..... 52/364
1,929,871 A * 10/1933 Jones ..... 52/509
2,035,902 A * 3/1936 Macleod ..... 52/410
4,567,100 A * 1/1986 Pickett et al. ..... 428/339
4,577,448 A * 3/1986 Howorth ..... 52/584.1
4,578,910 A * 4/1986 Germeroth et al. ..... 52/105
4,697,294 A * 10/1987 Schafer ..... 14/69.5
4,824,498 A * 4/1989 Goodwin et al. ..... 156/71
4,831,806 A 5/1989 Niese et al.
4,860,516 A * 8/1989 Koller et al. ..... 52/480
4,890,434 A 1/1990 Niese
4,922,670 A * 5/1990 Naka et al. ..... 52/126.6

(Continued)

OTHER PUBLICATIONS

Robbins Inc., Pages from Robbins Sports Surfaces website www.robbinsfloor.com.

(Continued)

*Primary Examiner*—Robert J Canfield
*Assistant Examiner*—Brent W Herring
(74) *Attorney, Agent, or Firm*—Wood, Herron & Evans, LLP

(57) ABSTRACT

An athletic floor uses a panel-type subfloor to secure directly to a concrete base. The panel-type sections include upper and lower rigid layers which sandwich a resilient layer. The rigidity of the lower layer spans most uneven spots in the floor, while the resilient layer provides some degree of a compressibility and/or conformability, as needed, to provide a flat horizontal surface for supporting a layer of floorboards thereabove. The panel sections can be secured directly to the base, via anchors which secure the lower rigid layers to the base, the anchors residing in access openings formed along the perimeter of the upper rigid layer and in the resilient layer. This anchoring arrangement enables each anchor to hold at least two adjacently located panel sections, and it also eliminates precompression of the resilient layer. The subfloor panel sections are prefabricated, at the factory, and then shipped to the installation site. Overall, a subfloor of panel-type sections of this type provides a high degree of stability, resiliency, and uniformity in these parameters, with simpler and lower cost installation.

12 Claims, 4 Drawing Sheets

U.S. PATENT DOCUMENTS

| | | | | | |
|---|---|---|---|---|---|
| 4,930,280 | A | * | 6/1990 | Abendroth | 52/403.1 |
| 4,995,210 | A | | 2/1991 | Niese et al. | |
| 5,016,413 | A | | 5/1991 | Counihan | |
| 5,183,438 | A | * | 2/1993 | Blom | 472/92 |
| 5,388,380 | A | * | 2/1995 | Niese | 52/480 |
| 5,411,352 | A | * | 5/1995 | Eren | 404/31 |
| 5,412,917 | A | * | 5/1995 | Shelton | 52/403.1 |
| 5,428,935 | A | * | 7/1995 | Mitchell | 52/698 |
| 5,433,052 | A | | 7/1995 | Niese | |
| 5,566,930 | A | | 10/1996 | Niese | |
| 5,609,000 | A | * | 3/1997 | Niese | 52/480 |
| 5,653,099 | A | * | 8/1997 | MacKenzie | 52/403.1 |
| 5,667,444 | A | * | 9/1997 | Caballero | 472/92 |
| 5,778,621 | A | | 7/1998 | Randjelovic | |
| 5,906,082 | A | * | 5/1999 | Counihan | 52/403.1 |
| 5,935,675 | A | * | 8/1999 | Hayden et al. | 428/71 |
| 6,055,785 | A | | 5/2000 | Counihan | |
| 6,073,409 | A | | 6/2000 | Chambers | |
| 6,115,981 | A | | 9/2000 | Counihan | |
| 6,122,873 | A | | 9/2000 | Randjelovic | |
| 6,158,185 | A | | 12/2000 | Counihan | |
| 6,164,031 | A | * | 12/2000 | Counihan | 52/480 |
| 6,199,328 | B1 | * | 3/2001 | McGrath et al. | 52/127.1 |
| RE37,615 | E | | 4/2002 | Niese | |
| 6,363,675 | B1 | * | 4/2002 | Shelton | 52/403.1 |
| 6,367,217 | B1 | | 4/2002 | Niese et al. | |
| 6,637,169 | B2 | | 10/2003 | Niese et al. | |
| 6,688,065 | B2 | | 2/2004 | Chambers | |
| 6,883,287 | B2 | | 4/2005 | Niese et al. | |
| 7,096,632 | B2 | * | 8/2006 | Pacione | 52/506.05 |
| 7,121,052 | B2 | | 10/2006 | Niese et al. | |
| 7,383,663 | B2 | * | 6/2008 | Pacione | 52/120 |
| 2002/0124515 | A1 | * | 9/2002 | Pacione | 52/509 |
| 2005/0257474 | A1 | * | 11/2005 | Randjelovic | 52/480 |
| 2007/0022711 | A1 | * | 2/2007 | Paradis et al. | 52/796.1 |
| 2008/0172968 | A1 | * | 7/2008 | Pacione | 52/403.1 |

OTHER PUBLICATIONS

Action Floor Systems, LLC, Pages from Action Flooring's website www.actionfloors.com.

Connor Floors, Pages from Connor Floors' website www.connorfloor.com.

* cited by examiner

PANEL-TYPE SUBFLOOR FOR ATHLETIC FLOOR

This application claims priority to U.S. Provisional Application Ser. No. 60/694,282, filed on Jun. 27, 2005, which application is incorporated by reference herein in its entirety.

FIELD OF THE INVENTION

The present invention relates to floors, and more particularly, to hardwood sport floors having a wear layer supported over a base by an intermediate subfloor having enhanced uniformity in performance characteristics.

BACKGROUND OF THE INVENTION

Wood floors remain popular for athletic and residential applications, for a number of reasons including aesthetics, quality, stability, ease of maintenance, durability, etc. One popular type of wood floor employs parallel rows of tongue and groove floorboards, laid end to end, across the entire floor surface.

Particularly with hardwood sports floors used primarily for athletics, such as basketball, it is desirable to provide some degree of cushioning, or impact absorption, for the upper surface of the floor relative to the base, or underlying surface. This is typically done by supporting the floorboards above the base via pads, and in most cases the floorboards are secured to the top of some intermediate structure, with the pads located below the intermediate structure, supported on the base. The use of pads in this manner creates an open air space, or air break, between the floor and the base, thereby minimizing moisture ontake by the intermediate structure or the floorboards, which are usually made of wood. If the structure does not include some mechanism for attachment to the base, the floor is said to be "free floating" relative to the base.

In some cases it is desirable to secure, or anchor, the floor to the base, primarily for stability and to minimize the potentially adverse effects of floorboard expansion and contraction which may occur as a result of moisture ontake and/or egress as humidity levels change with the seasons. Also, this moisture-caused expansion and contraction of floorboards adversely affects the performance uniformity of the floor. Thus, anchoring the floor helps to assure uniformity in performance. These dual objectives, to resiliently support the floorboards above the base and to anchor the floorboards to the base, are not easy to achieve simultaneously. Because of this situation, there have been a number of developments in the athletic hardwood floor industry.

More specifically, assignee's U.S. Pat. No. 5,388,380, entitled "Anchored/Resilient Sleeper for Hardwood Floor System" ("Niese '380") and issued in the name of Mike Niese, discloses several anchoring arrangements for anchoring attachment members to a base, with the attachment members supported on pads residing on the base and anchored in a manner which does not precompress the pads. Generally, Niese '380 relates to resiliently anchoring parallel rows of relatively narrow elongated attachment members which are spaced from each other.

Another patent of the present assignee, U.S. Pat. No. 5,609,000, entitled "Anchored/Resilient Hardwood Floor System" and also issued to Mike Niese ("Niese '000"), discloses, among other things, some variations in the subfloor structure which resides between the floorboards and the pads. Niese '000 is expressly incorporated by reference herein, in its entirety. These variations maintain the benefits of anchoring and resiliency in a manner which does not precompress the pads, while also simplifying the way in which these objectives are achieved.

For these types of floors, as perhaps with all floors, there remains a high customer demand for additional improvements, lower costs, shorter installation time, uniformity in performance, all without any reduction in the floor's other attributes. For suppliers and installers, there is a demand for easier handling, and reduced quantity and/or type of materials.

It is an object of the present invention to optimally achieve these customer, supplier, and installer demands, primarily the demands for reduced costs and shorter installation time, for floors that are anchored or free floating relative to a base, or resiliently supported above the base.

It is also an object of the invention to supply a uniformly stable and resilient hardwood floor, with relatively low labor costs, reduced complexity, and fewer different types of installation components.

SUMMARY OF THE INVENTION

The present invention achieves the above-stated objects via a subfloor comprising a plurality of sandwich-like panel sections, each panel section having a resilient layer sandwiched between upper and lower rigid layers. The panel sections are preferably prefabricated and shipped to the installation site in ready to install form. To install, the downwardly directed surface of the lower rigid layer is placed directly on the base, or on a moisture barrier covering the base. These panel sections require no shims. Their relatively large surface area and the conformity of the pad (or pads) which occupy the middle of the "sandwich" allow this subfloor of panels to conform to the base, to provide a horizontal support surface despite some unevenness in the base, within reasonable tolerances.

These panels can be used to create a free floating floor, or alternatively an anchored/resilient floor.

The combination of stability and resiliency in a panel-type structure enhances the overall uniformity of the floor, whether anchored or not. That is, the panel sections have a high degree of uniformity in point elasticity, area defection, and a good degree of dampening, or deflection attenuation, without dead spots. Moreover, the panel sections are relatively easy to arrange in a desired fashion over a base. Also, the panel sections can easily be anchored in a manner which does not precompress the resilient layer. This can be achieved by providing access openings in the upper rigid layer and in the pad layer, to enable the lower rigid layer to be directly accessed for anchoring to the base.

The resilient layer may be one continuous panel-type pad, or it may include a plurality of smaller pads. The upper and lower rigid layers preferably comprise plywood, but other suitable rigid materials may also be used.

A plurality of these subfloor panel sections are placed end to end in parallel rows, preferably spanning the width of the floor. Then the sections are anchored to the base by driving anchors through the lower rigid layers of the sections. With this structure, the anchors do not precompress the resilient layer at all, because the anchors do not span a vertical distance in which the resilient layer resides. Preferably, at the anchor points there is direct access to the top surface of the lower rigid layer, such as via an access opening formed in the resilient layer and the upper rigid layer. Preferably, anchoring occurs along the perimeter of the sections, so that each anchor provides anchored securement of at least two adjacently located panel sections.

If desired, a top subfloor layer of rigid panels may be placed on the sections, oriented at a 45°, angle so as to lap the joints of the subfloor panel sections. With this arrangement, the wear layer (preferably floorboards) are secured to this top subfloor. If a top subfloor layer is used in this manner, it may be relatively low thickness, such as ⅜ inch. Similarly, with this structure the rigid upper layer of the panel sections may be of the same reduced thickness, i.e. ⅜ inches. If desired, to further assure defection attenuation, one or more surfaces of the upper or lower rigid layers of the panel sections, or one or both of the top and bottom surfaces of the top subfloor, may be kerfed.

Also, it may be desired to use a multiple pieces to form the rigid upper layer of the panel sections, with one piece forming the rigid lower layer. This large lower layer simplifies installation. At the same time, the breaks between the upper layer pieces help to enhance deflection attenuation.

The wear layer may comprise maple or other hardwood strips, as well as nonstructural wear surfaces. Due to the unique strength, resiliency and other desirable characteristics of the subfloor panel sections, relatively thin (e.g., about 0.5 inch) maple strips may be used for the wear surface. Comparatively, most conventional systems require hardwood strips having a thickness of 0.75 inch or more.

Again, with these panel type subfloor sections, the invention achieves a high tensile strength through the interaction of the respective layers. The panel sections provide superior dampening, easier installation, no precompression of the pads, and consistent acoustics throughout the entire surface area of the floor, thereby enhancing player performance. Also, the use of preformed panel sections, shipped from the factory, reduces the installation costs and the potential for installer error. Moreover, the variability of the dimensions of the prefabricated subfloor panel sections enables relatively convenient transport and storage.

This invention uses readily available and relatively low cost materials. For instance, the rigid layers of the subfloor sections may be formed from plywood, or any other suitably strong material of relatively uniform thickness. Compared to other floors, the floor of this invention achieves superiority in the degree of uniformity in stability and resiliency, but with readily available materials, lower cost, and simplified installation.

The general concepts of this inventive floor are also adaptable to various other permutations. For instance, the dimensions of the subfloor panel sections may vary depending on the particular application. For instance, while exemplary dimensions are shown in the drawings (e.g., measuring width-wise about a foot and a half to four feet in width), other panel section dimensions could actually include a relatively narrow width, but generally a width greater than about three inches. Such relatively narrow subfloor sections could be laid end to end in parallel rows, and spaced apart relative to one another. For instance, such elongated sleeper-type sections could be spaced about 8 to 16 inches apart.

These and other features of the invention will be more readily understood in view of the following detailed description and the drawings.

DETAILED DESCRIPTION OF THE PREFERRED EMBODIMENTS

Figure 1:
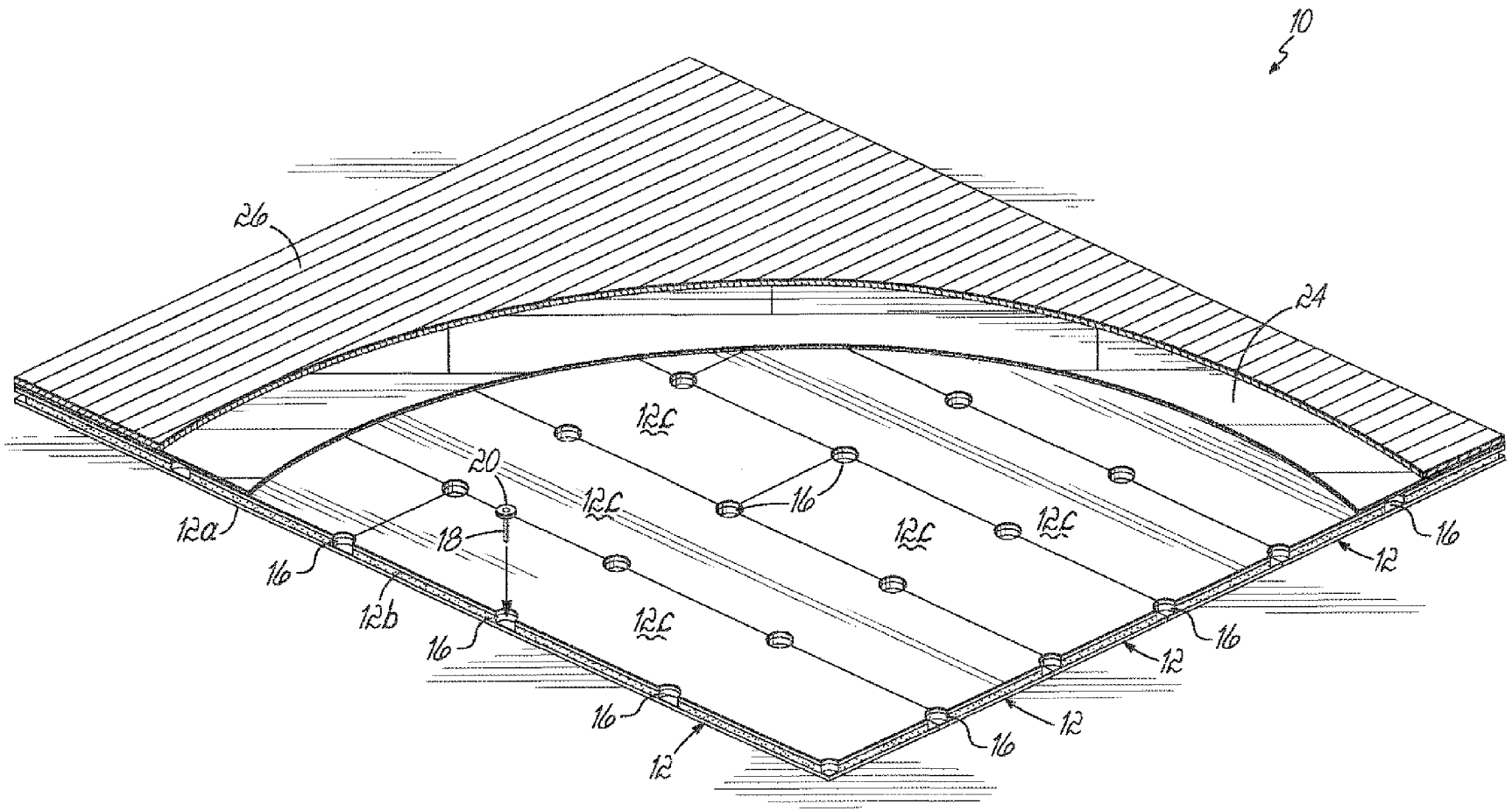
FIG. 1 is a perspective view of panel-type subfloor for an athletic floor, in accordance with a first preferred embodiment of the invention.

To install the floor 10 of this invention, a suitable number of subfloor panel sections and floorboards are shipped to the installation site, along with suitable fasteners if the floor is to be anchored. As shown in FIG. 1, the panel-type sections 12 are arranged end to end in parallel rows, spanning the width of the floor 10. This will be the width of a basketball floor, if the floor 10 is to be used in a gymnasium. Notably, the panel sections 12 are placed directly on the base 14 (FIG 3), or if desired, on a moisture barrier (not shown) residing on top of the base. There is no need for the installer to supply additional structure, such as shims, to accommodate slight unevenness in the floor. Rather, the resiliency of the pad layer of the subfloor panel sections 12, in combination with the rigidity of the upper or lower rigid layers of the section, accommodates a certain acceptable degree of unevenness, to provide an upper surface which is essentially horizontal.

In FIG. 1, the subfloor panel sections 12 are 8 feet long and 2 feet wide. The lower rigid layers 12*a* are of uniform thickness, preferably ½ inch and made of plywood. The resilient layer 12*b* is preferably a panel-type resilient pad, preferably of the type sold by assignee under the trademark "Zero/G." This is a breathable pad which allows moisture flow therethrough. This pad 12*b* may be secured to one or both of the upper 12*c* and lower 12*a* rigid layers by adhesive, which may be applied by a roller.

In a preferred embodiment, the lower rigid layers 12*a* are of uniform length and width. Nonetheless, the invention also contemplates the use of a relative large single piece to form the lower rigid layer 12*a*, with multiple pieces used to form the upper rigid layer 12*c*.

If the panel-type subfloor is to be anchored to the base 14, during fabrication the panel sections 12 are provided with perimeter access openings 16 to facilitate anchoring. As shown in FIG. 1, each panel section 12 includes four half circular shaped access openings 16 located at intermediate points along the longitudinal edges the upper rigid layer 12*c*, and four quarter circular shaped openings formed in the four corners of the upper rigid layer 12*c*. Similar openings are formed in the resilient layer 12*b*. These openings 16 essentially represent discontinuities in the upper rigid layer 12*c* and in the resilient layer 12*b*. So when the subfloor panel sections 12 are arranged in a desired pattern on the base 14, the access openings 16 are formed by the alignment of the portions of the circular shapes defined by the adjacently located panel sections 12.

Figure 2:
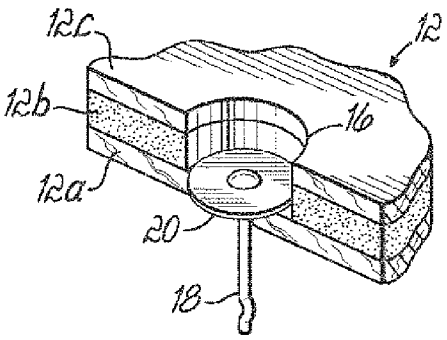
FIG. 2 is a detailed view of an enlarged portion of the floor shown in FIG. 1.

FIG. 2 shows a perspective view of one such opening 16. A concrete spike 18 extends downwardly through the lower rigid layer 12*a*, with a flat washer 20 included to supply additional anchoring strength. Because the spike or anchor 18 is driven downwardly through the lower rigid layer 12*a* of plywood, it does not vertically span across any dimension occupied by the pad. Thus, the driving of the anchors 18 to install these panel sections 12 does not precompress the pads 12*b* in any way.

Figure 3:
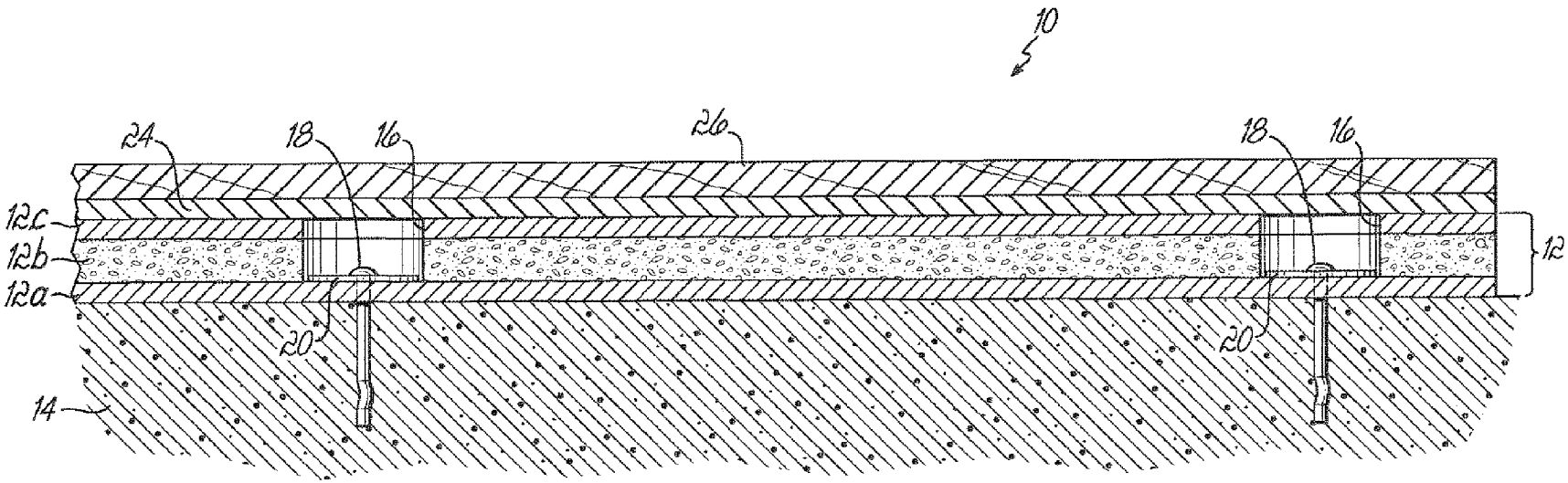
FIG. 3 is longitudinal cross sectional view, along the rows of the subfloor panel-type sections shown in FIG. 1.

If desired, a top subfloor layer 24 may be arranged on the subfloor panel sections, as shown in FIG. 1. Preferably, this top subfloor 24 is arranged at a 45° angle, to overlap the joints of the panel sections 12 residing therebelow. Thereafter, a wear layer 26, in this case tongue-in-groove floorboards, are secured to the top layer 24. FIG. 3 shows a cross sectional, horizontal view along one of the panel sections 12. FIG. 3 also shows that above the anchors 18 there is a slight spacing between the longitudinal edges of the adjacently located subfloor panel sections 12. This spacing is known in the industry, with respect to panel-type subfloors for floor systems.

Figure 4:
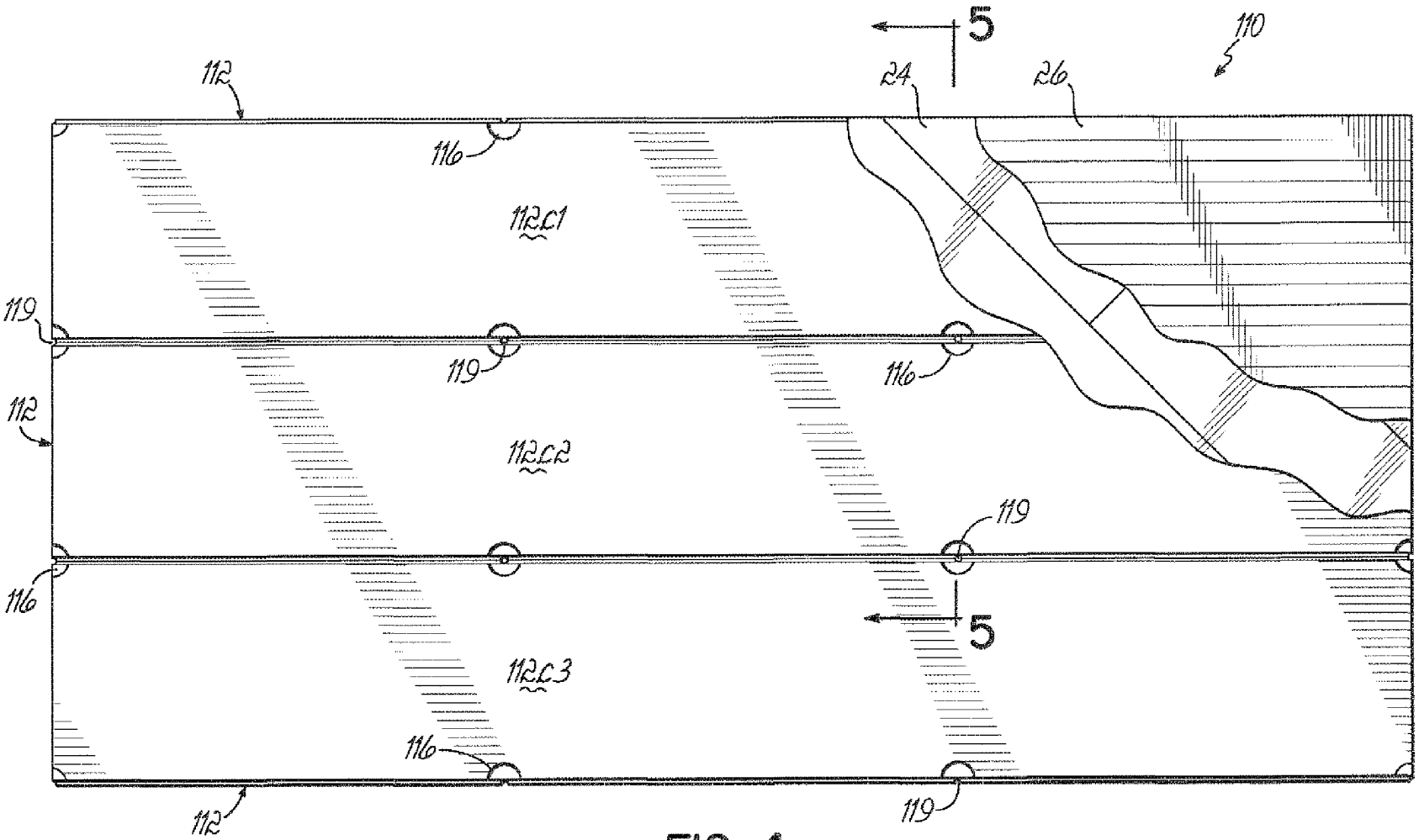
FIG. 4 is a plan view of a subfloor panel section, in accordance with another aspect of the invention.
Figure 5:
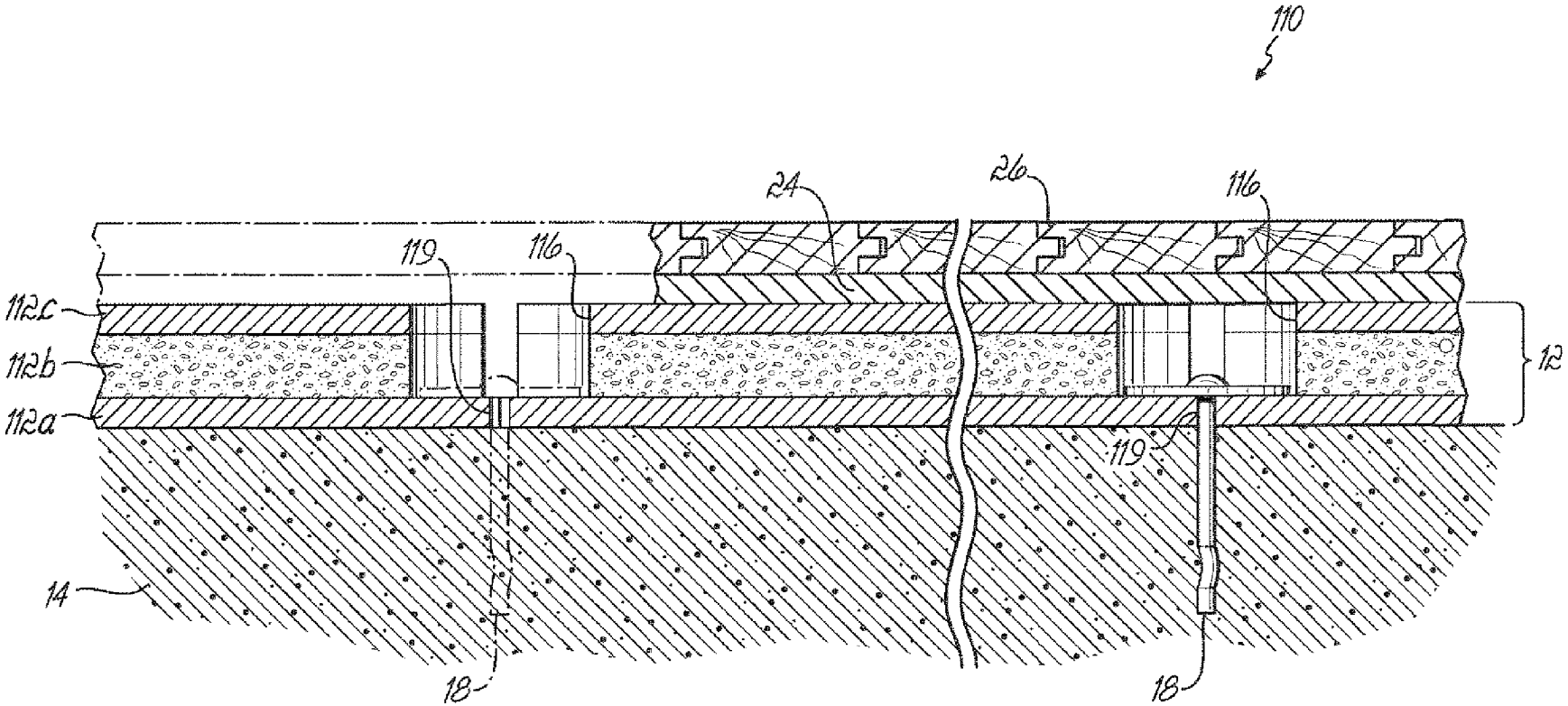
FIG. 5 is a cross sectional view along lines 5-5 of FIG. 4.

FIG. 4 shows the dimensions of a subfloor sandwich-type panel section 112 constructed in accordance with another aspect of the invention. More specifically, in FIG. 4 the subfloor panel section 112 includes a lower rigid layer 112*a* of one piece, and an upper rigid layer 112*c* of three spaced longitudinal pieces 112*c*1, 112*c*2, and 112*c*3. FIG. 4 shows a spacing, i.e., preferably of about 0.25 inches, between the longitudinal edges of these adjacently located pieces 112*c*1, 112*c*2, 112*c*3 of the upper rigid layer 112*c*. With this arrangement, the lower rigid layer 112*a* is 4 feet in width and 8 feet in length, while each of the three pieces 112*c*1, 112*c*2, 112*c*3 of the upper rigid layer is about 15.83 inches in width (just short of 16 inches) and 8 feet in length. With this structure, openings 116 are located around the perimeter of the panel section 112, but also internally of the panel section 112, along the internal perimeters of the pieces 112*c*1, 112*c*2, and 112*c*3. For these internal openings 116, the lower rigid layer 112*a* preferably includes small sized openings 119 for downwardly extending the anchors 18, as shown in FIGS. 4 and 5. This type of subfloor panel section 112 is pre-made at the factory in this manner.

With this structure, on-site installation is facilitated, because each of the subfloor panel sections 112 has an overall dimension of 4 feet wide by 8 feet long and the installable dimensions of the panel sections 112 are dictated by the dimensions of the lower rigid layer 112*a*. Thus, the number of panels 112 that need to be arranged on the base 14 is reduced to a number which is as low as reasonably possible. Yet, because of the multple pieces of the upper layer 112*c*, and the discontinuities residing therebetween, this structure provides an added degree of vibration dampening within the surface area of floor 110 occupied by each such panel section 112. This helps the floor 100 to attenuate area deflection upon impact, and it also reduces noise levels.

Compared to prior floors, the installation of the present floor 10, 110 is relatively simple and can be done at low cost. Due to the sandwich structure of the intermedately located subfloor panel sections 12, 112, this invention achieves an anchored floor 10, 110 with no precompression of the resilient layer 12*b*, 112*b*, and with very few different types of components. Even compared to other free floating hardwood floors, or other anchored floors that may have little or no resilience, the present invention presents a number of advantages to the end user, namely a uniformly stable and resilient hardwood floor 10, 110 with substantially lower installation, handling, and material costs.

While this application describes one presently preferred embodiment of this invention, those skilled in the art will readily appreciate that the invention is susceptible of a number of structural variations from the particular details shown and described. For instance, not all of the above layers may be used in certain embodiments that are consistent with the invention. More particularly, one system may not have one of the upper or lower subfloor panels. Therefore, it is to be understood that the invention in its broader aspects is not limited to the specific details of the embodiment shown and described. The embodiment shown and described is not meant to limit in any way or to restrict the scope of the appended claims.

We claim:

1. A floor comprising:

an upper wear layer residing over a base;

a subfloor residing on and in surface contact with the base and supporting the wear layer, the subfloor including a plurality of panel sections of predetermined dimension, each of the panel sections including upper and lower rigid layers sandwiching an intermediate resilient layer, the panel sections arranged end to end in parallel rows and the plurality of lower rigid layers of the panel sections substantially covering the base;

a plurality of anchors holding the lower rigid layers to the base, the anchors residing entirely below the upper wear layer; and access openings formed in the upper rigid layers, thereby to enable the anchors to be secured to the base so as to hold the lower rigid layers wherein the access openings are defined by aligned cut out portions of adjacently located panel sections, so that a single anchor holds at least two adjacently located panels.

2. The floor of claim 1 further comprising:

a top subfloor between the wear layer and the panel sections, the wear layer secured to the top subfloor.

3. The floor of claim 1 wherein the wear layer comprises a plurality of parallel rows of tongue and groove floorboards laid end-to-end.

4. The system of claim 1 wherein the rigid upper and lower layers of the panel sections comprise plywood.

5. The floor of claim 1 wherein the panel sections are prefabricated such that the upper and lower rigid layers are pre-secured to the resilient layer, such that the upper, lower, and resilient layers of the panel sections are simultaneously installable.

6. The floor of claim 1 where for each panel section, the upper and lower rigid layers are generally uniform in width and length.

7. The floor of claim 1 wherein the upper rigid layer has a lower thickness than the lower rigid layer.

8. The floor of claim 1, wherein, for at least some of the panel sections, the rigid lower layer comprises a single piece and the rigid upper layer comprises multiple pieces.

9. A method of forming a floor comprising:

arranging a plurality of panel sections over a base to form a subfloor, the panel sections arranged end-to-end in parallel rows oriented in a first direction, each of the panel sections including upper and lower rigid layers sandwiching an intermediate resilient layer, the arranged rows of panel sections defining a plurality of aligned access openings along adjacently located edges of corresponding, adjacently located panel sections, the access openings formed in the upper rigid layer of the adjacently located panel sections, wherein the subfloor panel sections of any given row of panel sections is staggered with respect to an adjacently located row of panel sections;

anchoring the panel sections to the base at the access openings via anchors driven downwardly alongside the lower rigid layers of at least two adjacently located panel sections, and into the base, such that each anchor holds the at least two adjacently located panel sections; and securing an upper wear layer of elongated floorboards to the subfloor, the elongated floorboards secured end-to-end in parallel rows to cover the subfloor.

10. The method of claim 9 further comprising:

installing a top subfloor of panels above the subfloor of panel sections, the top subfloor of panels oriented in rows that are angled with respect to the rows of the panel sections, with the upper wear layer of elongated floorboards secured to the top subfloor.

11. A floor made by the process of claim 9.

12. The method of claim 9 wherein the longitudinal dimension of the elongated floorboards intersects the first direction of the rows of panel sections.

* * * * *